US010563472B2

(12) United States Patent
Johnson

(10) Patent No.: US 10,563,472 B2
(45) Date of Patent: Feb. 18, 2020

(54) ROTARY MILLING TOOL

(71) Applicant: Wellbore Integrity Solutions LLC, Houston, TX (US)

(72) Inventor: Ashley Bernard Johnson, Cambridge (GB)

(73) Assignee: Wellbore Integrity Solutions LLC, Houston, TX (US)

( * ) Notice: Subject to any disclaimer, the term of this patent is extended or adjusted under 35 U.S.C. 154(b) by 306 days.

(21) Appl. No.: 15/339,717

(22) Filed: Oct. 31, 2016

(65) Prior Publication Data

US 2017/0122051 A1 May 4, 2017

(30) Foreign Application Priority Data

Nov. 2, 2015 (GB) ..... 1519332.9

(51) Int. Cl.
*E21B 29/00* (2006.01)

(52) U.S. Cl.
CPC ..... *E21B 29/005* (2013.01)

(58) Field of Classification Search
CPC ..... E21B 29/002; E21B 29/005
See application file for complete search history.

(56) References Cited

U.S. PATENT DOCUMENTS 3,475,165 A 10/1969 Cape
4,938,291 A * 7/1990 Lynde ..... B23B 5/16 166/55.8
4,978,260 A * 12/1990 Lynde ..... B23B 5/16 166/55.6
5,456,312 A 10/1995 Lynde et al.
2003/0155155 A1 8/2003 Dewey et al.
2010/0012387 A1* 1/2010 Huynh ..... E21B 10/43 175/428
2011/0240367 A1 10/2011 Guidry et al.
2012/0292052 A1 11/2012 Xu et al.
2015/0152702 A1 6/2015 Stowe et al.
2015/0167394 A1 6/2015 Xia et al.
(Continued)

FOREIGN PATENT DOCUMENTS

WO WO2011041685 A2 4/2011

OTHER PUBLICATIONS

Combined Search and Exam Report of United Kingdom Patent Application No. 1519332.9 dated Apr. 27, 2016, 6 pages.
(Continued)

*Primary Examiner* — Robert E Fuller

(57) ABSTRACT

A downhole rotary tool for comminuting tubing in a borehole comprises a tool body and a plurality of cutting assemblies projecting from or extensible from the tool body and distributed azimuthally around a longitudinal axis of the tool body. Each cutting assembly comprises a supporting structure and a plurality of cutters with cutting surfaces of hard material. The rotating tool is advanced into initial contact with the tubing to commence milling axially along the tubing and then advanced further to continue milling the tubing, At least one cutting assembly has material which is softer than the hard faces of the cutters and is positioned to contact the tubing at the initial contact and delay contact between at least one hard surfaced cutter and the tubing.

19 Claims, 11 Drawing Sheets

(56) References Cited

U.S. PATENT DOCUMENTS

| | | | | |
|---|---|---|---|---|
| 2017/0081921 | A1* | 3/2017 | Evans | E21B 10/43 |
| 2018/0045009 | A1 | 2/2018 | Johnson et al. | |

OTHER PUBLICATIONS

Search Report and Written Opinion of International Patent Application No. PCT/US2016/059973 dated Mar. 6, 2017, 12 pages.
International Preliminary Report on Patentability of International Patent Application No. PCT/US2016/059973, dated May 8, 2018 (8 pages).

* cited by examiner

ROTARY MILLING TOOL

CROSS-REFERENCE TO RELATED APPLICATIONS

This application claims benefit of United Kingdom patent application number 1519332.9, filed Nov. 2, 2015 and titled ROTARY MILLING TOOL, the entire disclosure of which is herein incorporated by reference.

BACKGROUND

There are occasions when it is necessary to remove a length of tubing which has been fixed in place in a borehole. This tubing may be borehole casing which is surrounded by cement. Sometimes such removal of a length of tubing is done in preparation for setting a cement plug when a well is being abandoned. Removing a length of tubing which has been fixed within a borehole is customarily done with a rotary milling tool, customarily referred to as a section mill or casing mill, which comminutes the tubing to swarf.

Rotary milling tools frequently have a tool body and a plurality of cutting assemblies projecting from or extensible from the tool body and distributed azimuthally around a longitudinal axis of the tool body, wherein each cutting assembly comprises a steel supporting structure and a plurality of cutters with cutting surfaces made of a harder material, which may be sintered tungsten carbide.

It is normal that the rotation of the tool is started with little or no weight on the tool and then weight is applied, pushing the tool axially downwards into contact with the tubing and thereby starting the milling operation in which the tool cuts while driven in rotation and urged axially forward by the weight on the tool.

SUMMARY

This summary is provided to introduce a selection of concepts that are further described below. This summary is not intended to be used as an aid in limiting the scope of the subject matter claimed.

Disclosed now is a tool and method for removing tubing within a borehole.

A first aspect of the present disclosure is concerned with a method of comminuting tubing in a borehole comprising bringing a rotating tool into initial contact with the tubing to commence milling and then advancing the rotating tool axially to continue milling the tubing, wherein the tool comprises a tool body and a plurality of cutting assemblies projecting from or extensible from the tool body and distributed azimuthally around a longitudinal axis of the tool body; and each cutting assembly comprises a supporting structure and a plurality of cutters with cutting surfaces of hard material.

In the method disclosed here, at least one cutting assembly comprises material which is softer than the hard faces of the cutters and is positioned to contact the tubing at the initial contact and delay contact between at least one hard surfaced cutter and the tubing.

The rotating tool may be brought into the initial contact with the tubing by applying weight to the tool and thereby advancing the tool axially into contact with the tubing.

In a second aspect, this disclosure provides a downhole rotary tool for comminuting tubing in a borehole comprising a tool body and a plurality of cutting assemblies projecting from or extensible from the tool body and distributed azimuthally around a longitudinal axis of the tool body, wherein each cutting assembly comprises a supporting structure and a plurality of cutters with cutting surfaces of hard material, wherein the tool is configured for material on at least one cutting assembly, which material is softer than the cutting surfaces of the cutters, to contact the tubing before at least one of the hard surfaced cutters when the tool is advanced axially onto the tubing.

We have appreciated that there is a risk of impact damage to hard surface cutters as the tool makes contact with the tubing and starts the milling operation. Some section mills are able to rotate in a stable position in the course of milling tubing but have a less stability in their rotational position as they come into contact with the tubing and start the milling operation. This increases the risk of damage at the start of milling.

As disclosed here, material which is not as hard as the cutting surfaces makes the initial contact with tubing, which may reduce the risk of damage to hard faced cutters. Stable rotation of the tool, with damping of vibration, may be established during delay before contact between one or more hard faced cutters and the tubing.

The hard surfaces of cutters may have Knoop hardness of at least 1300, possibly at least 1600, 1800 or more. The cutters may be bodies of a hard material. Tungsten carbide is a material which is commonly used for cutters because it is very hard and also has good thermal stability. Other hard materials which may be used are carbides of other transition metals, such as vanadium, chromium, titanium, tantalum and niobium. Silicon, boron and aluminium carbides are also hard carbides. Some other hard materials are boron nitride and aluminium boride. A hard material may have a Knoop hardness of 1300, 1600, 1800 or even more.

The softer material which makes initial contact with tubing may be metal with a Knoop hardness not exceeding 1300 and possibly not exceeding 1000. The softer material may be steel. Some types of steel have Knoop hardness below 500. Tool steel is harder and some types of tool steel have Knoop hardness of approximately 850. Even harder metals are also available: for instance nickel alloys disclosed in U.S. Pat. No. 3,475,165 have a have Knoop hardness between 1000 and 1100.

The softer material may be positioned between at least one hard surfaced cutter and the tubing so that the least one cutter cannot contact tubing until the soft material which blocks such contact has been worn away through contact with the tubing. With such an arrangement the softer material may have Knoop hardness below 700.

In another arrangement, the softer material may be positioned axially ahead of at least one hard faced cutter, in a position where the softer material will cut into the tubing, or be cut by the tubing, or some combination of those two, and this cutting interaction between the softer material and the tubing must take place after the initial contact, thereby allowing axial advance of the tool until the at least one hard-faced cutter comes into contact with the tubing.

One or more of the hard surfaced cutters may have a shape of cutting surface and a position on the tool such that at least part of the cutting surface is back raked, that is to say it is inclined relative to the direction of rotation such that an edge where the cutting surface cuts furthest into the tubing, coupling or other outward projection is a trailing edge of the cutting surface relative to the direction of rotation and extends from the said edge with a back rake angle which is from 15° to 70° (possibly between 30° and 60°) and at the said edge has an angle greater than 90° included between the cutting surface and the surface of the cutter body following the cutting surface. When there is such a rake angle in a range from 15° to 70° between at least part of the cutting surface and a perpendicular to the direction of traverse relative to the workpiece, the angle between the cutting surface or part thereof and the direction of rotation lies in a range from 20° to 75°.

As disclosed in a currently unpublished GB patent application, we have found that a cutting surface with a large back rake angle leads to the formation of swarf with less rigidity. It may be in the form of short pieces weakly connected together, or sometimes not connected at all. Changing the nature of the swarf reduces the risk of entangled swarf forming a "birds nest" blockage in the borehole. A significant back rake may require the cutter to be pressed against the tubing with more force than would be required with less back rake or none. In a machine-shop context, a requirement for increased force between a cutting tool and workpiece would be a disadvantage, but we have recognized that when operating a cutting tool in a wellbore, a requirement for greater force is beneficial. More force can be provided by increasing weight on the tool. Control of the cutting speed by varying the weight on the tool then becomes easier. Increasing the included angle between the cutting surface and a surface of the body behind the cutter surface makes the cutter more robust and reduces the risk of the cutter being chipped or broken.

The cutter body may be such that the at least part of the back raked cutting surface extends at least 2 mm from the said edge where the cutting surface cuts furthest into the tubing and the cutter body's surface trailing back from the said edge extends at least 2 mm possibly at least 3 mm or at least 5 mm back from the said edge.

An individual cutting assembly may comprise a plurality of cutters positioned to cut into the tubing and the cutting positions of these cutters may be arranged so that distance from a leading end of the rotary tool increases as radial distance from the tool axis increases, whereby removal of tubing progresses outwardly as the tool advances. For at least one cutter, the supporting structure of each cutting assembly may have a radially outward facing guide surface at the same radial distance from the tool axis as the radial extremity of the cutter, positioned to slide over a surface created on the tubing interior by that cutter.

The rotary tool may have cutting assemblies which are fixed to the tool body and project radially outwardly. Such a tool may be used when it is possible to access the end of the tubing and start milling at the accessible end. However, in some forms of the tool, the cutting assemblies are extensible from the tool body by operation of a drive mechanism. The tool may then be inserted into tubing with the cutting assemblies retracted and when the tool is at the position where milling is to start, the cutting assemblies are extended by operation of the drive mechanism and cut outwards through the tubing as they are extended.

Consequently, some forms of the method include a preliminary of expanding the cutting assemblies and cutting outwardly through the tubing, before advancing the rotating tool axially into initial contact with the tubing to commence milling.

The rotary tool may have at least three cutting assemblies distributed azimuthally around it at the same axial position. For instance there may be three cutting assemblies at 120° azimuthal intervals around the tool body, four at 90° azimuthal intervals or six at 60° azimuthal intervals.

When the tool has expandable cutting assemblies, the drive for their expansion may be powered hydraulically by fluid pumped from the surface. The drive may be arranged to expand a plurality of cutting assemblies, distributed azimuthally around the tool body, in unison. The travel of the cutting assemblies as they are expanded may be motion around a pivotal attachment to the tool body or it may be a motion in which the cutting assemblies move outwardly without changing their orientation relative to the tool body. The latter may be brought about by constraining each cutting assembly to be movable along a pathway. More specifically pathways may be angled relative to the tool axis and configured so that when the cutting assemblies are moved axially they also move outwardly in unison.

The length of tubing which is removed by the tool and method above may be considerable. It may for example be a length which is many times (for instance more than 10 times) greater than the axial length of the tool itself. The length of tubing removed may be 5 metres or more. The removal of tubing may be carried out for various reasons, but in some instances it may be done before plugging and abandoning the borehole.

DETAILED DESCRIPTION

FIGS. 1 to 7 show a rotary milling tool with fixed cutting assemblies used for milling tubing when it is possible to access an upper end of the tubing. For example, casing milling downwards from the top of a borehole may be carried out when it is required to place a sealing plug at a modest depth below the surface, such as within 700 metres of the surface as part of the process of abandoning a well.

As shown, an existing borehole is lined with lengths of tubing 12 (wellbore casing) which are joined end to end. Couplings between lengths of tubing are not shown in FIGS. 1 to 7. Cement 15 has been placed between the casing and the surrounding rock formation. The tubing 12 and cement 15 may have been in place for some years.

Figure 1:
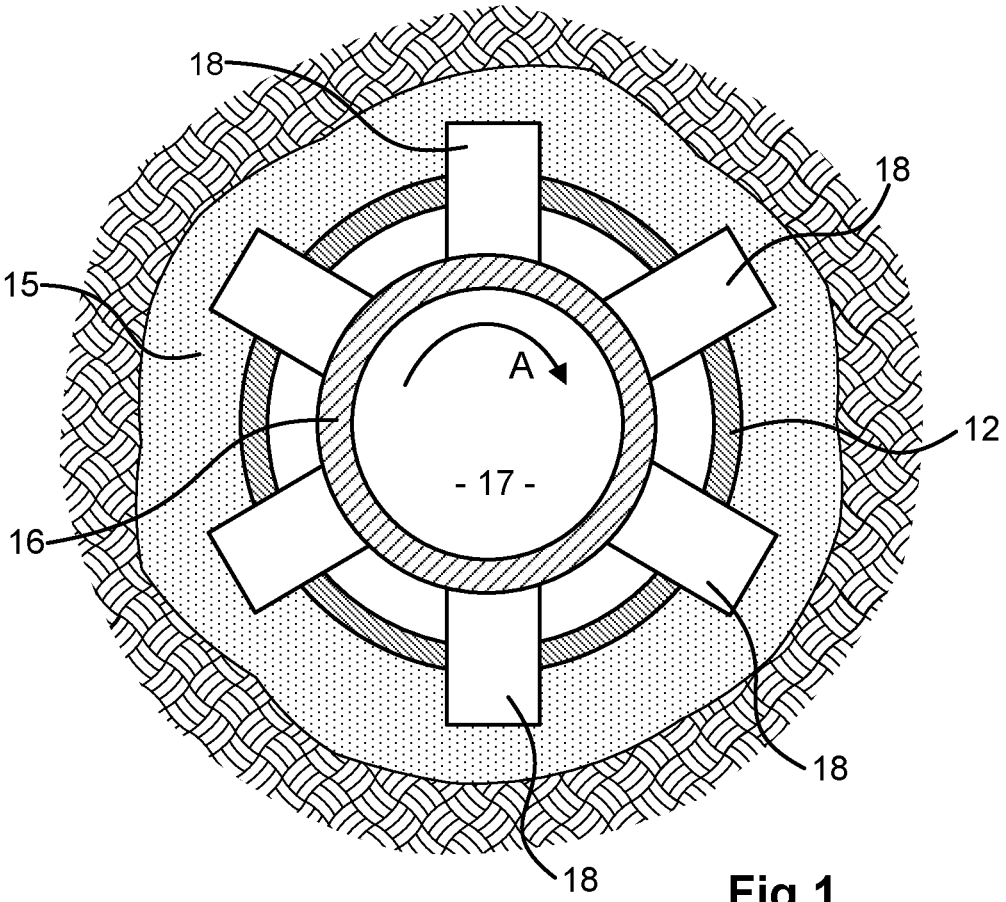
FIG. 1 is a schematic axial view of a rotary milling tool with fixed cutting assemblies, positioned to mill tubing from the top end downwards.

FIG. 1 schematically illustrates the tool and borehole looking axially from above. The tubing 12 is shown with hatching. The tool has a central hollow cylindrical body 16 which can be attached to the bottom end of a drill string. This body 16 defines a through passage 17 for drilling fluid pumped down the drill string. The fluid flows out of the bottom end of the tubing and returns up the annulus around the drill string in conventional manner. The direction of rotation is indicated by arrow A.

Figure 2:
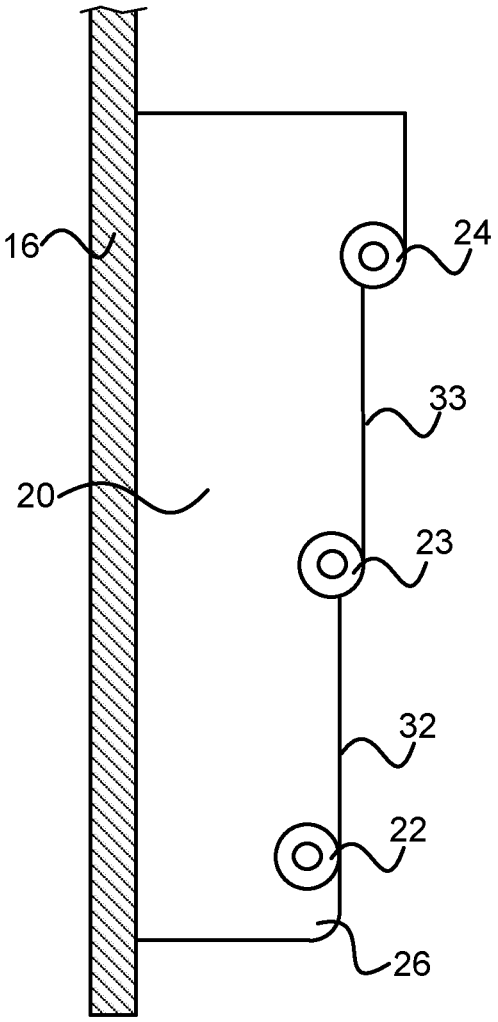
FIG. 2 shows a rotationally leading face of one cutting assembly of the tool of FIG. 1 before the tool is put into use.

Six cutting assemblies 18 are rigidly attached to the central body 16 and project radially out from it at 60 degree intervals azimuthally around the axis of the body. FIG. 2 shows the rotationally leading face of one cutting assembly 18 in its condition before the tool is used. Each cutting assembly comprises a supporting structure and cutters attached to it. The supporting structure is a steel block 20 rigid with the body 16. The cutters 22, 23 and 24 are generally cylindrical and secured in cavities in the block 20 so that they are partially embedded in block 20 with their leading ends exposed and facing in the direction of rotation. These cutters are bodies of a hard material. This hard material may be provided as tungsten carbide powder which is compacted into the shape of the cutter and then sintered giving a Knoop hardness greater than 1600. Manufacturers of sintered tungsten carbide cutters include Cutting and Wear Resistant Developments Ltd, Sheffield, England and Hallamshire Hard Metal Products Ltd, Rotherham, England.

Tungsten carbide is a material which is commonly used for cutters because it is very hard and also has good thermal stability. Other hard materials which may be used are carbides of other transition metals, such as vanadium, chromium, titanium, tantalum and niobium. Silicon, boron and aluminium carbides are also hard carbides. Some other hard materials are boron nitride and aluminium boride. A hard material used for cutters may have a hardness of at least 1300, or at least 1600 and possibly at least 1800 or more on the Knoop scale. By contrast, steel or other metal used for a supporting block 20 is likely to have a Knoop hardness below 700.

The cutters 22, 23 and 24 are secured in cavities in the block 20 by brazing, but other methods of securing cutters may be used if desired.

Figure 5:
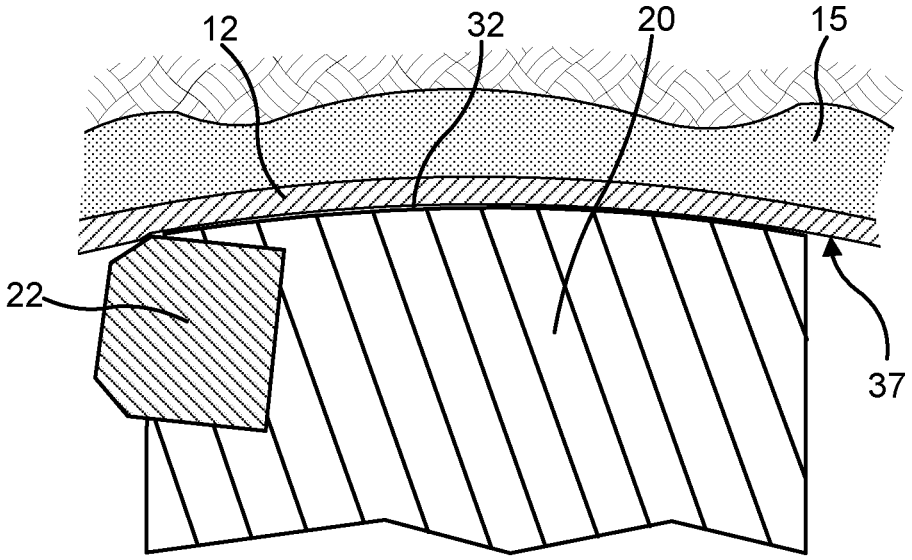
FIG. 5 is a cross section on line V-V of FIG. 4.

A radially outward facing surface 32 on the block 20 is a part-cylindrical outward facing surface 32 with a radius such that the surface 32 is centered on the tool axis. The cutter 22 is positioned so that its radially outer extremity is at the same distance from the tool axis as the surface 32. Thus, the radial extremity of the cutter 22 is aligned with the surface 32 as shown by FIG. 5. There is also a part-cylindrical outward facing surface 33 centered on the tool axis at larger radius from the tool axis. The extremity of cutter 23 is at the same distance from the tool axis as the surface 33 and so is aligned with it.

Figure 3:
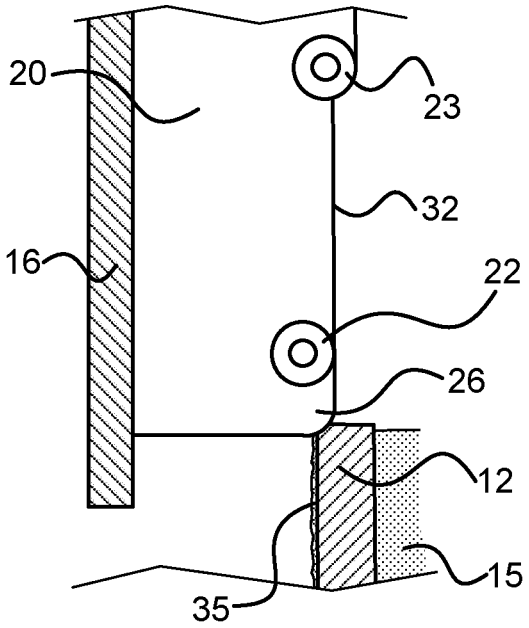
FIG. 3 is a partial view of the leading face seen in FIG. 2, when the tool makes initial contact with tubing.

FIG. 3 shows initial contact between the cutting assembly and tubing 12. The tubing is first contacted by a portion 26 of the block 20. This portion 26 extends axially ahead of the lowest cutter 22 and extends radially outward to align with the surface 32 and the radial extremity of cutter 22.

Figure 4:
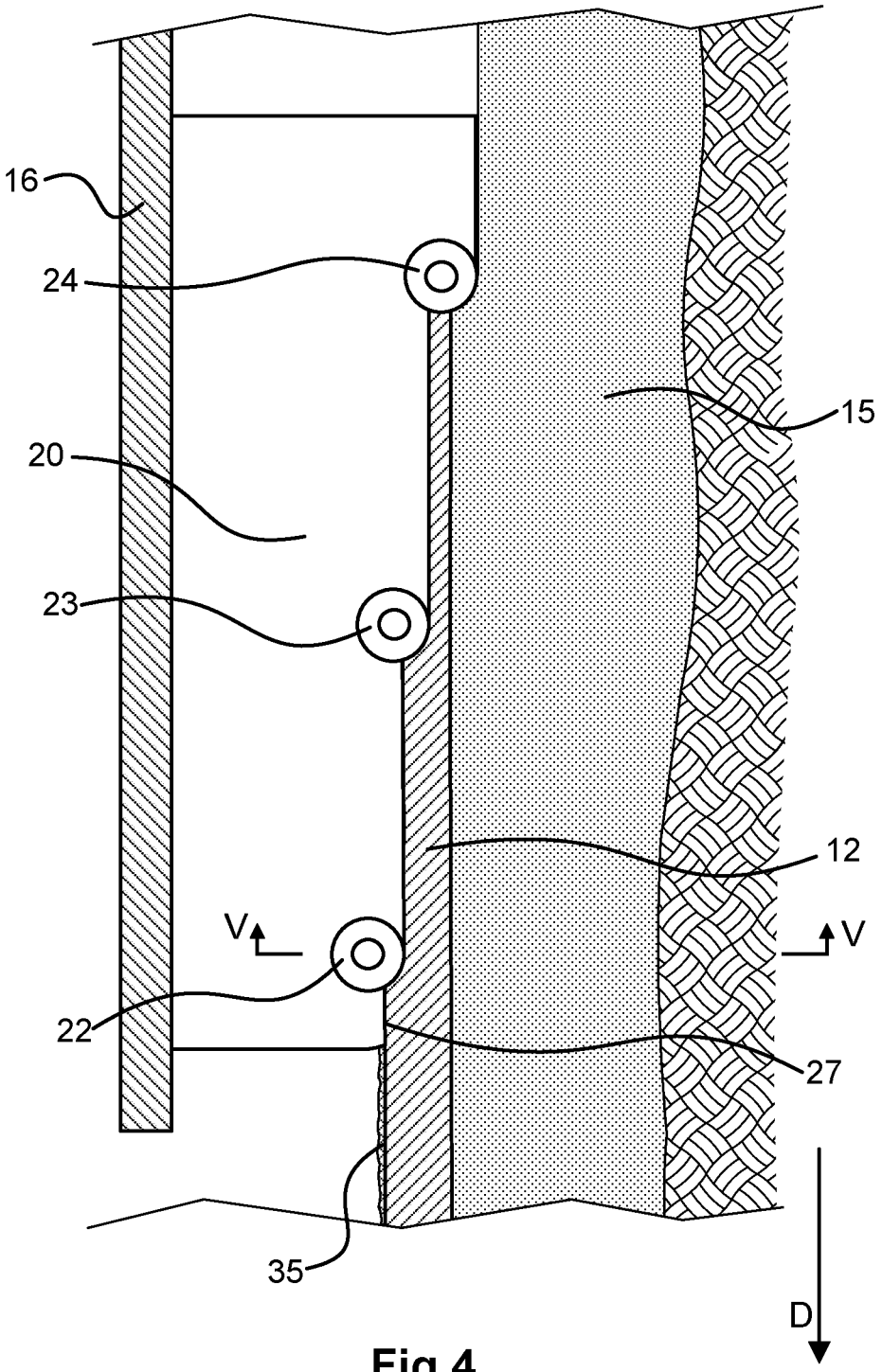
FIG. 4 shows the rotationally leading face seen in FIG. 2 when the tool is in use, after some wear.

Weight on the tool will press the portion 26 of block 20 against tubing 12. As the tool rotates, the portion 26 and tubing 12 which are both steel will abrade each other. The portion 26 will be worn away as the tool rotates and advances axially, until the condition shown in FIG. 4 is reached. The portion 26 has been worn down to the internal radius of the tubing 12, as indicated at 27. The hard cutters 22, 23, 24 of the tool now continuously mill away tubing 12 as the tool advances axially in the downward direction shown by arrow D. The tubing 12 may have some corrosion and deposited material on its inside surface as depicted schematically at 35. The axially leading cutter 22 on each block 20 is positioned to remove this material 35 and also remove some material from the inside wall of the tubing 12, thus creating a new inward facing surface on the tubing 12. This surface is indicated 37 in FIG. 5.

Because the part-cylindrical outward facing surfaces 32 are centered on the tool axis and aligned at the same radial distance from the tool axis as the extremities of the leading cutters 22, they are a close fit to the inward facing surface 37 created on the tubing by the cutters 22 as is shown in FIG. 5, and slide over this new inward facing surface 37 as the tool rotates. The cutters 23 remove a further thickness of tubing 12, creating a fresh inward facing surface on which the surfaces 33 slide. This close fit of surfaces 32, 33 to surfaces created on the tubing 12 positions the axis of the rotating tool accurately relative to the tubing 12.

As the tool progresses downwardly, the cutter 24 removes the remaining thickness of the tubing 12.

Figure 6:
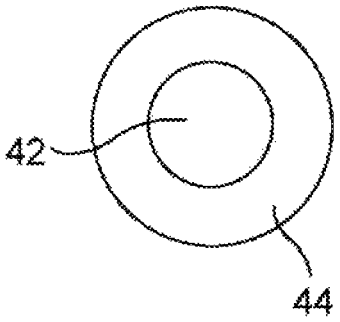
FIG. 6 is a face view of the leading end of a cutter.
Figure 7:
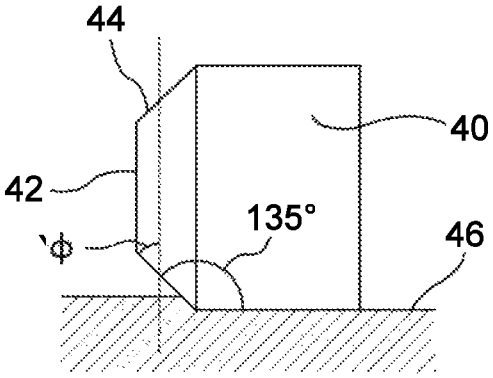
FIG. 7 is a side view of a cutter in contact with a workpiece.

FIGS. 6 and 7 show the shape of cutters 22, 23 and 24. Each of these cutters has a cylindrical body 40 and a shaped leading end in which a front face 42 with smaller diameter than the body 40 is surrounded by an annular surface 44 at an angle of 45° to the front face 42. The angle included between the side wall of the cutter body 40 and the annular surface 44 is 135°, as shown. When the cutter is mounted on a tool, part of the annular surface 44 is the cutting surface. With this geometry, the back rake angle $\varphi$ between the cutting surface 44 and a perpendicular to the substrate 46 (tubing or coupling) which is being cut is approximately 45°. We have discovered that cutting with this substantial back rake angle leads to swarf with much less mechanical strength and rigidity than swarf produced by cutters without any bake rake. This reduces the risk that pieces of the swarf will hook together and clog the path of flow back to the surface.

Figure 8:
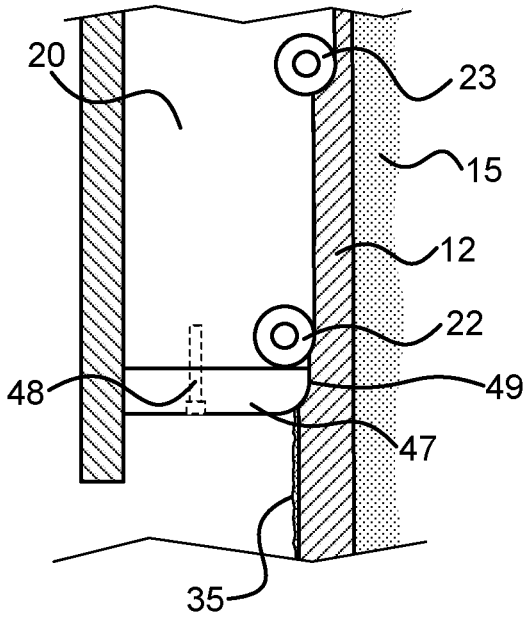
FIG. 8 is a partial view of the leading face of a cutting assembly, showing a modification.

FIG. 8 shows a possible modification. The hard cutter 22 is at the lower end of block 20, but the block 20 is extended axially downwards by a steel piece 47 attached to block 20 by bolt 48. A benefit of using a piece 47 attached to block 20 is that the tool can be used again after replacing worn pieces 47 with new ones. The piece 47 is made of tool steel with Knoop hardness in the range 700-900. This is softer than the hard cutters 22, 23 and 24 but harder than the steel casing 12 which is being milled.

The piece 47 is dimensioned so that it projects radially outwardly slightly beyond the inside surface of the tubing 12 although it does not extend radially outward as far as the extremity of the cutter 22 above it. The radially outward face (seen as edge 49) of the piece 47 is a part cylindrical surface centred on the tool axis. When the rotating tool is advanced against the end of tubing 12, initial contact is made with the radially outer region of piece 47. This piece 47 acts as cutter and cuts material from the inside wall of tubing 12 creating a new inward facing surface on the tubing 12. The outward face 49 of the piece 47 slides on this newly created surface. The cutting action of piece 47 allows the tool to advance axially as it rotates and after a number of rotations the radially outer parts of hard cutter 22 contact the tubing 12 and begin to remove additional thickness from the inside wall of the tubing.

Although the piece 47 is harder than the tubing 12, it is slowly worn away through contact with the tubing 12. As the piece 47 wears and cuts less thickness from the tubing, the hard cutter 22 continues to cut to its radial extremity aligned with the following surface 32 as described above with reference to FIG. 4.

Figure 9:
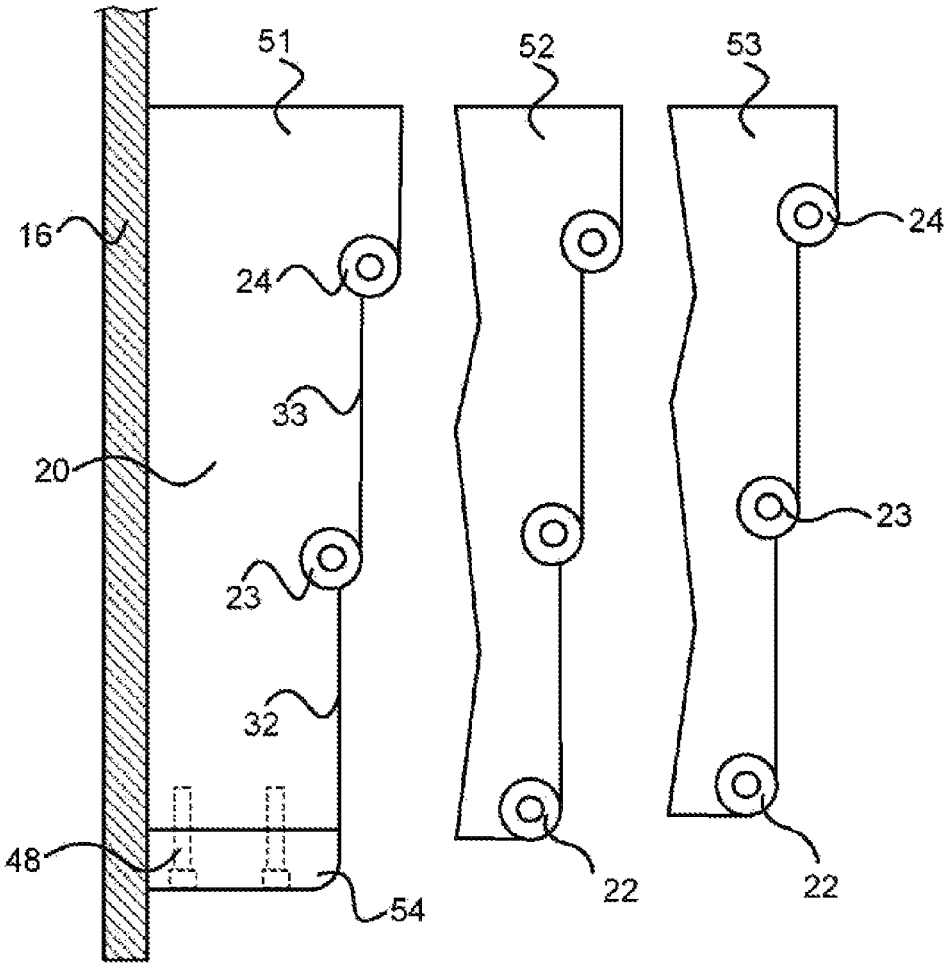
FIG. 9 shows a rotationally leading face of one cutting assembly and outer regions of two more.

The cutting assemblies 18 projecting from tool body 16 may be identical to each other but this is not necessarily the case. One possibility is that they all have a general layout as shown by FIG. 2, but differ slightly in dimensions. FIG. 9 shows an arrangement where this is done and where one cutting assembly is used to create delay after initial contact. This cutting assembly 51 is shown on the left of FIG. 9. The outer regions of two cutting assemblies 52, 53 which follow as the tool rotates are shown alongside. All three assemblies have similar layouts to that shown in FIG. 2 except that the cutting assembly 51 lacks cutter 22. The cutters 23 and 24 on assembly 52 are located axially above the corresponding cutters on assembly 51 and are also at slightly greater radial distance from the tool axis. Similarly, the cutters 22, 23 and 24 on assembly 53 are located axially above the corresponding cutters on assembly 52 and are also at slightly greater radial distance from the tool axis. As the tool rotates, corresponding cutters of these cutting assemblies cut to progressively greater radius.

The assembly 51 has a replaceable piece 54 made of tool steel attached at its lower end and held in place by two bolts 48. The function of this piece 54 is similar to that of piece 47 shown in FIG. 8. When the tool makes initial contact with tubing 12, this piece 54 begins to cut from the inside wall of the tubing and the tool makes a number of rotations before the hard cutter 22 on the following assembly 52 contacts the tubing and begins cutting.

Figure 10:
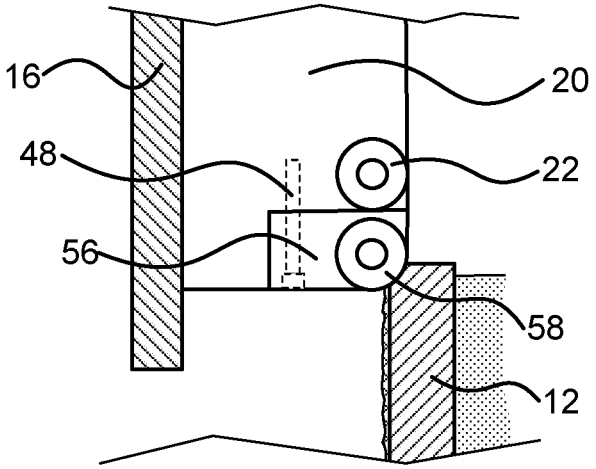
FIG. 10 is another partial view of the leading face of a cutting assembly, showing a different modification.
Figure 11:
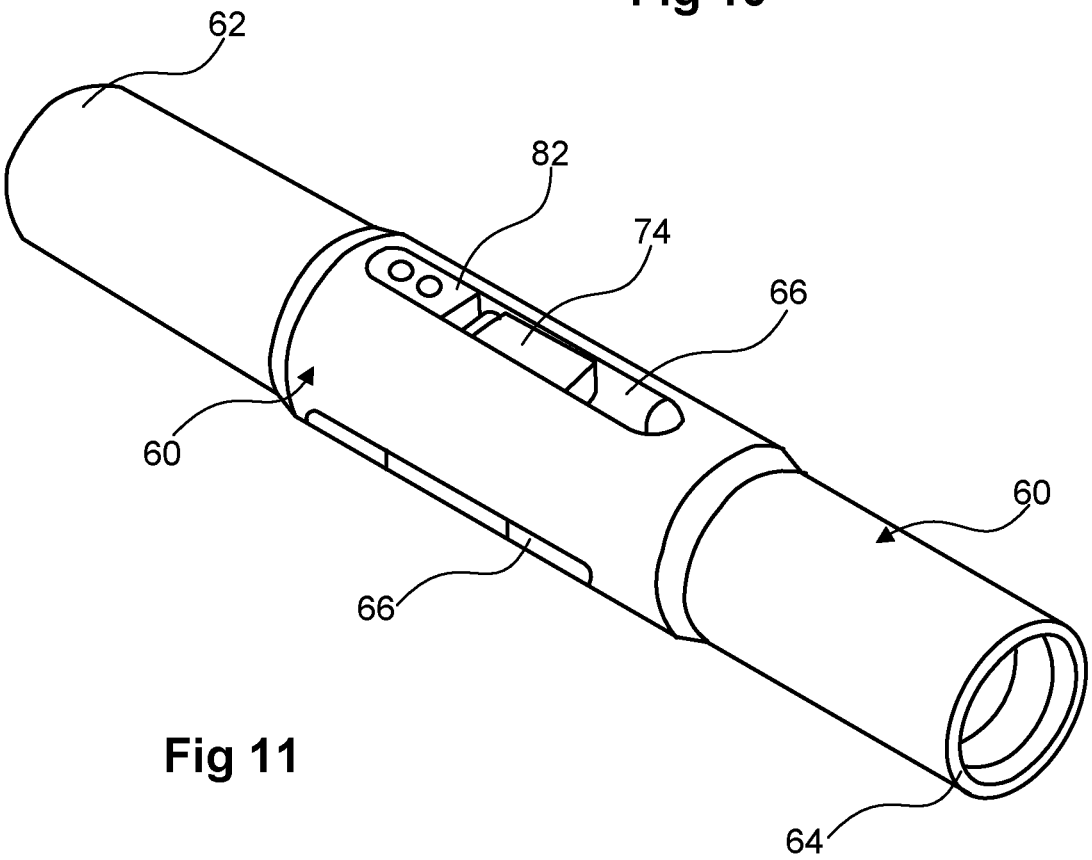
FIG. 11 is a perspective view of an expandable rotary milling tool.

FIG. 10 shows a further variation. At the lower end of a cutting assembly, a replaceable piece 56 is attached to the main block 20 by bolt 48. The block 20 supports hard cutters partially embedded in cavities as described already and these cutters include a hard cutter 22 spaced from the lower end of block 20. The piece 56 is made of the same steel as the block 20 but it includes a cavity which accommodates a cutter 58 which is made of tool steel and has the shape shown in FIGS. 6 and 7.

In use, as the tool advances axially onto the end of tubing 12, the cutter 58 makes initial contact with the tubing and begins to cut the tubing. Eventually, when the tool steel cutter 58 and the outer region of piece 56 are worn away, cutting is continued by the hard cutter 22. A cutting assembly as shown in FIG. 10 could be used as the assembly 51 in FIG. 8.

FIGS. 11 to 18 show a rotary milling tool which is expandable downhole. This allows the tool to be inserted to a chosen depth through existing tubing which is not going to be removed, then expanded to cut outwardly through the tubing before being made to advance axially to remove a length of tubing. This may be done in preparation for setting a cement plug at some depth when a well is being abandoned. This embodiment of rotary tool includes provision for milling couplings which join sections of casing.

Figure 12:
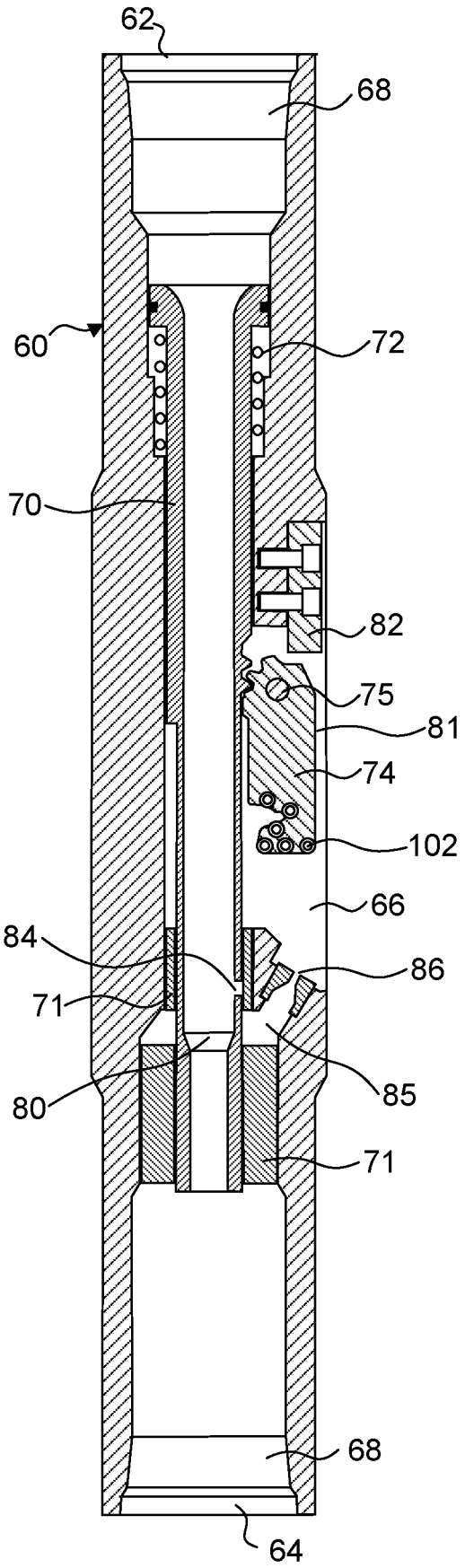
FIG. 12 is a sectional elevation of the tool of FIG. 11 with the extensible cutting assemblies retracted.

FIGS. 11 to 14 show the general layout and function of the expansion mechanism of this tool. This expansion mechanism is of a type already in use for expandable reamers. As seen in perspective view in FIG. 11, the tool has a tubular main body 60 with upper end 62 and lower end 64. In a central section there are three longitudinal slots 66 distributed at 120° intervals around the tool axis. The tool can be incorporated into a drill string. As shown in FIG. 12, the upper and lower end regions include portions 68 which are threaded to enable connection to standard drill pipe.

A central tube 70 is a sliding fit within the main body 60. Axial movement of the tube 70 is guided by the body 60 and sleeves 71 fixed to the body 60. This tube 70 is urged upwardly by a return spring 72. Each slot 66 houses an arm 74 which can swing through 90° around pivot 75 from the retracted position shown in FIG. 12 to the extended position shown in FIG. 14. The inner end of each arm 74 is formed with projections 76 which function as gear teeth. These mesh with projections 78 from the tube 70.

When the tool is in its retracted condition as shown in FIG. 12, drilling fluid pumped down the drill string can flow downwardly through the tube 70 and out of the lower end 64 of the main body 60. When the tool, included within a drill string, has been lowered to the desired depth, a ball is dropped down the drill string. This ball is dimensioned to block the tube 70 at the restriction 80. Pressure of the drilling fluid then forces the tube 70 to slide downwards against the force of return spring 72, thereby compressing that spring. As the tube 70 moves downwards, the projections 78 on the tube meshing with the teeth 76 urge the arms 74 to rotate around their pivots 75 towards their fully extended position shown in FIG. 14 when the surfaces 81 of the arms 74 abut stop blocks 82 bolted to the main body 60. Downward movement of tube 70 allows some drilling fluid to flow out through opening 84, into chamber 85 and out through nozzles 86.

Each arm 74 carries a number of hard cutters which each have the general configuration shown by FIGS. 6 and 7, with a cylindrical body which is partially embedded in the arm 74 and an exposed leading end shaped so that the annular cutting surface is at a back rake. These cutters may be sintered tungsten carbide. The cutters are shown in FIGS. 11 to 14 but their positions are shown in more detail by FIGS. 15 to 17.

Figure 14:
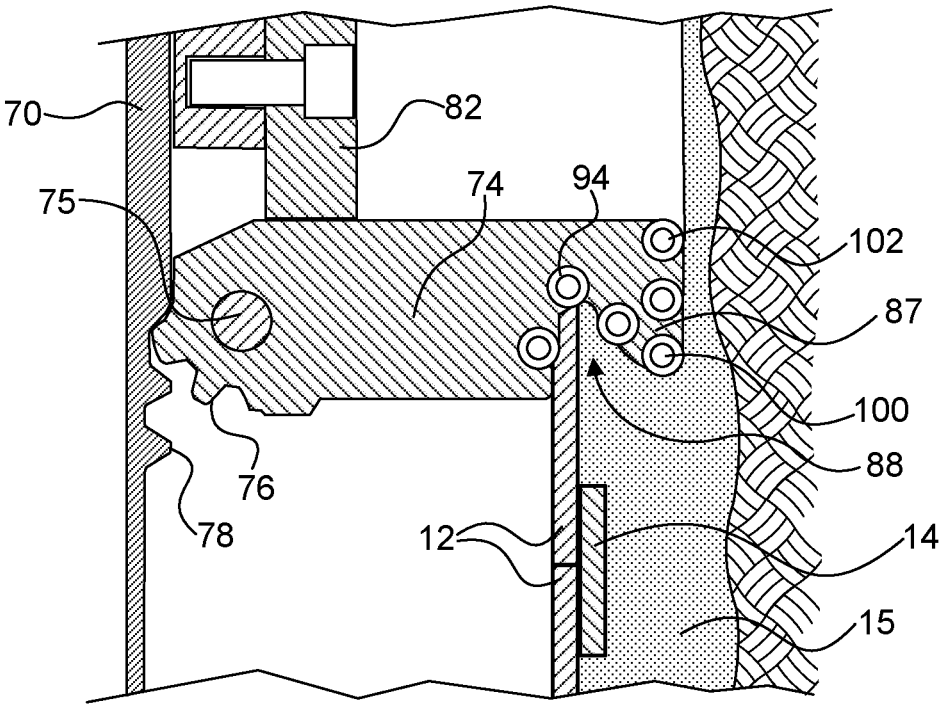
FIG. 14 is a sectional elevation of part of the tool of FIG. 11 with a cutting assembly fully extended and the milling operation in progress.
Figure 15:
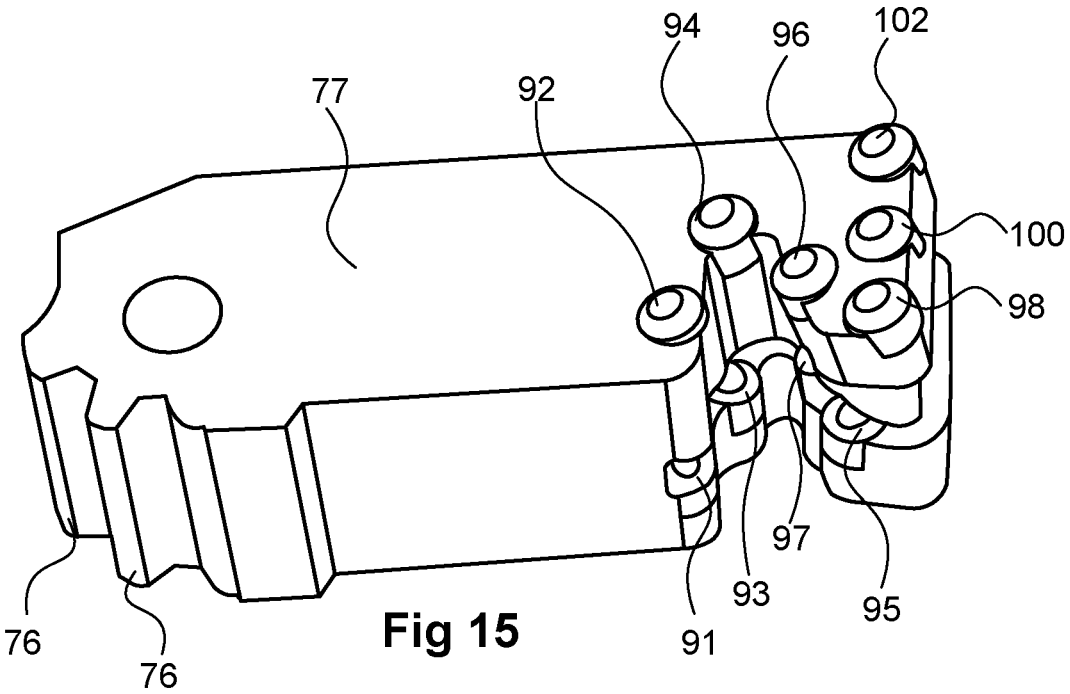
FIG. 15 is a perspective view of one cutting assembly.

FIG. 14 shows milling in progress with arm 74 fully extended. As shown, each arm 74 extends radially outwardly beyond the tubing 12 which is being cut. An outer portion 87 of the arm projects axially forwards at the exterior of the tubing and a recess 88 extends into the arm between this outer portion 87 and the remainder of the arm 74 which is within the tubing 12. FIG. 14 also shows a coupling 14 joining two lengths of tubing 12.

However, the axial extent of an arm 74 is limited by the space available for it within a slot 66. Consequently only some of the cutters on each arm are exposed at the leading face of the arm. This is shown by perspective view FIG. 15 and by FIG. 16 which is an enlarged view of the outer part of an arm seen from below. The radially outward end face of the arm incorporates a channel 89 which continues as channel 90 inwardly some distance along the underside of the arm. Cutters 92, 94, 96, 98, 100 and 102 have their leading ends exposed at the leading face 77 of the arm 74. Cutters 91, 93, 95 and 97 are behind the leading face of arm 74 and have their leading ends exposed in the channel 90. The radial and axial positions of the cutters are shown diagrammatically by FIG. 17. This shows the outline of the leading face of arm 74 and the cutters 92, 94, 96, 98, 100 and 102 which are exposed at this face. The diagram also shows, in the plane of the diagram, the radial and axial positions of cutters 91, 93, 95 and 97 which are behind the leading face of the arm 74.

Figure 13:
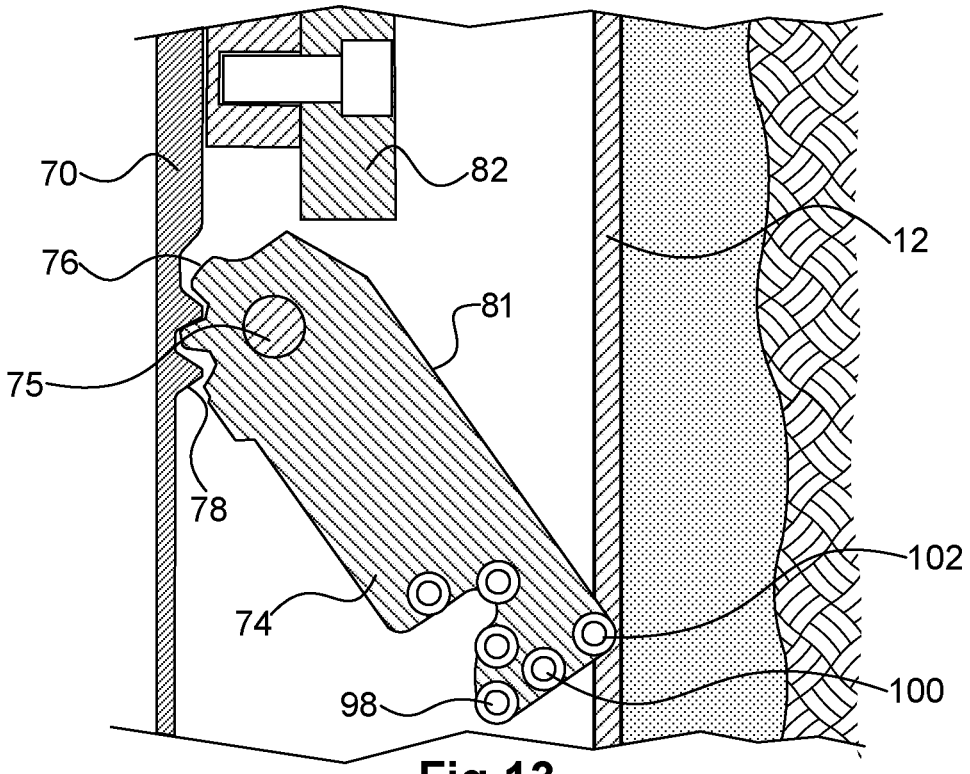
FIG. 13 is a sectional elevation of part of the tool of FIG. 11 with a cutting assembly partially extended.

For use the tool is attached to a drill string and lowered to the depth at which milling out of section of casing tubing 12 is required to start. The drillstring and tool are rotated but their axial positions are kept constant. Drilling fluid is pumped down the drill string and a ball is dropped to lodge at restriction 80 and start expansion of the arms 74. Initially each arm extends until the cutter 102 on the arm begins to cut into the tubing 12 as shown in FIG. 13.

As the arm cuts into the tubing 12, it expands further. After the cutter 102 cuts through the tubing, expansion continues with cutter 100 and then cutter 98 cutting the tubing. When the fully extended position of the arm 74 is reached, weight is applied to the tool so that axial advance of the tool begins.

Figure 17:
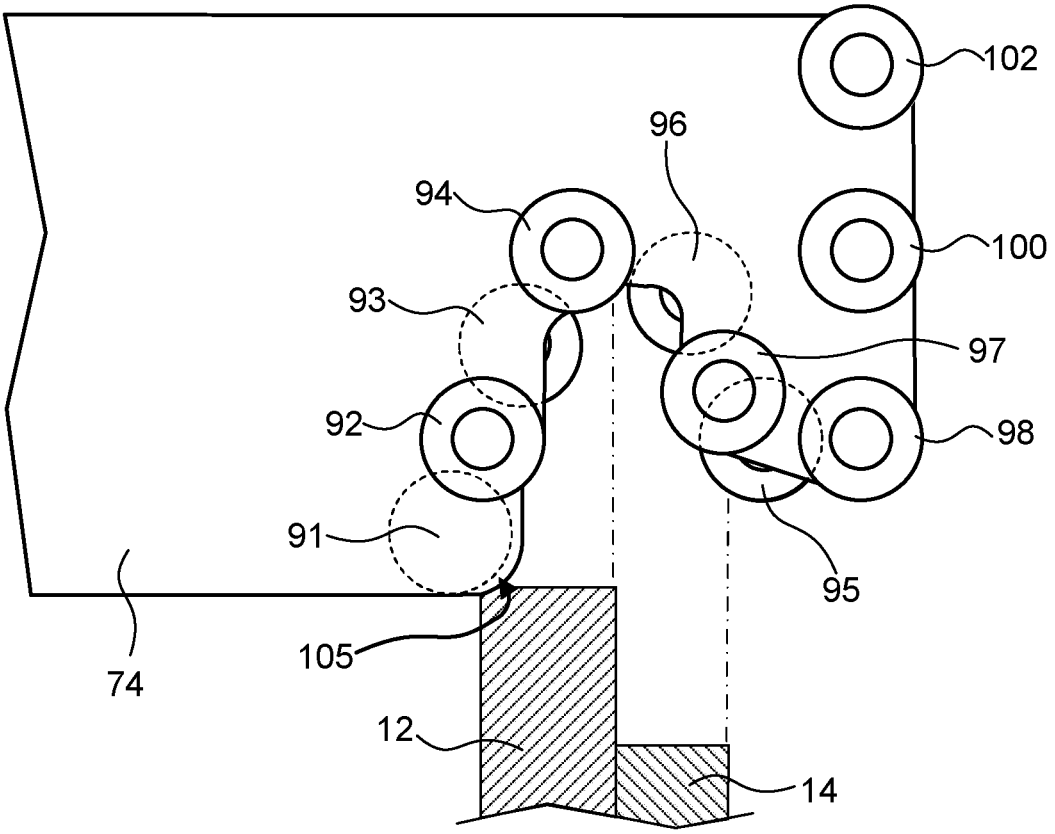
FIG. 17 diagrammatically shows the radial and axial layout of cutters of an assembly before wear in use.
Figure 18:
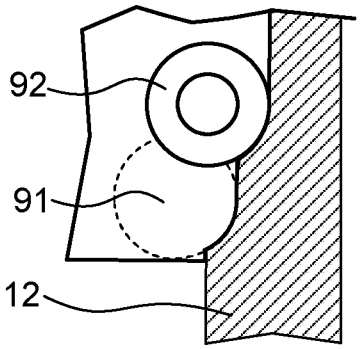
FIG. 18 is a partial view showing two cutters after wear.

It can be seen from FIG. 17 that the axially leading cutter 91 is positioned to follow behind a region 105 which is part of the front face of the arm 74 and formed by structural steel of the arm. Consequently, when weight is applied to the tool and the expanded arms 74 make contact with the tubing 12, the initial contact is with the region 105 of each arm. This region initially blocks initial contact between the tubing and cutter 91, but the region 105 is abraded through contact with the tubing and after some of the region 105 has been worn away the cutter 91 contacts the tubing and begins to cut it. FIG. 18 shows the worn state when part of the region 105 has been worn away and the tubing is being cut by the cutters 91 and 92.

Tubing 12 is progressively cut from the interior working outwards. The first cut is made by cutter 91, the second by cutter 92 which is exposed at the leading face 77 of the arm 74 and then further cuts by cutters 93 and 94. It may be noted that the centre of cutter 94 is positioned slightly inward from the exterior of the tubing 12.

Figure 16:
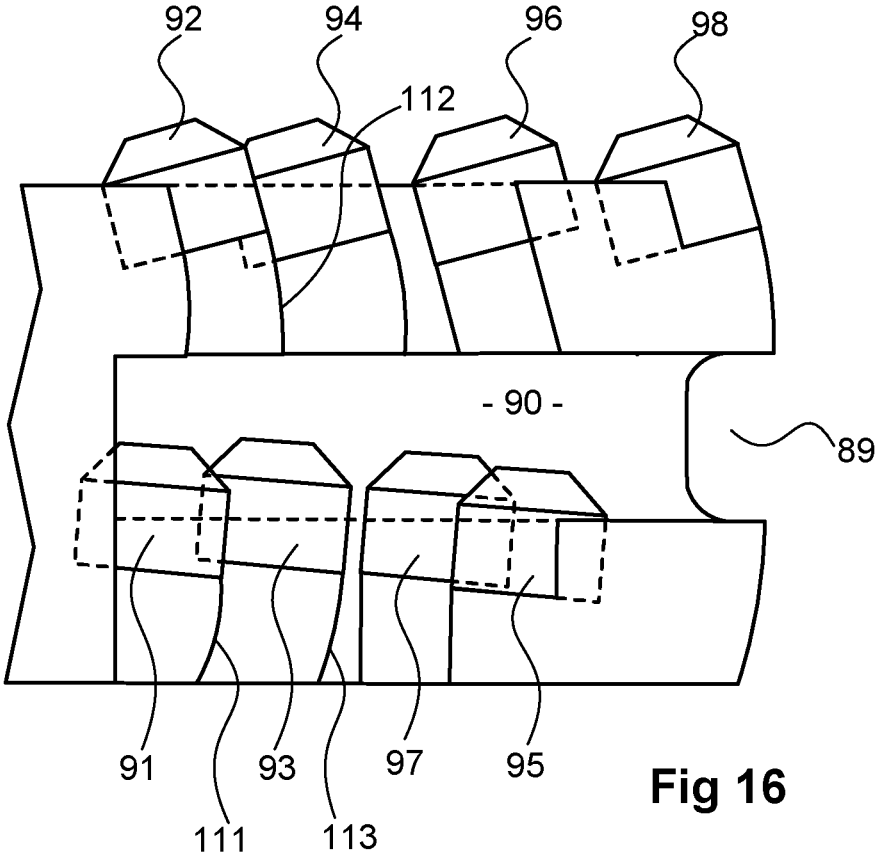
FIG. 16 is an enlarged underneath view of the cutting region of a cutting assembly.

The steel structure of arm 74 includes surfaces 111, 112 and 113, seen as edges in FIG. 16, which are aligned with extremities of cutters 91, 92 and 93 so that these surfaces slide on new metal surfaces cut on the tubing by the cutters 91, 92 and 93 respectively and thereby position the tool in the tubing 12. As can be seen from FIGS. 14 and 17, when the tool reaches a coupling 14, the coupling will initially be cut by cutter 95, then by cutter 96 followed by cutter 97. The cutter 97 has a back rake of 60°. This very large back rake enables the cutter to push the remnant of the coupling 14 hard against tubing 12. The remnants of the coupling and tubing are finally removed by cutter 94.

The three arms 74 which are distributed at 120° intervals around the body 60 are similar to each other in the number and layout of cutters. However, they may vary slightly in the axial and radial positioning of cutters. For instance the cutters 91 92 and 93 on one arm 74 may be positioned at slightly greater radius and axially slightly above the corresponding cutters on the preceding arm 74. Cutters on the next arm 74 may be at greater radius still, but further above axially. With such an arrangement all the cutters 91, 92 and 93 on the three arms 74 can cut helices as they rotate and advance so that the work of cutting tubing is shared by all the cutters on all three arms.

Other mechanisms may be used to expand cutters to mill tubing, and concepts disclosed here may be used with such mechanisms. US2003/0155155 is one of several documents in which the expansion of three cutting assemblies from a cylindrical tool body is brought about by a mechanism which uses the pressure of drilling fluid to drive cutter blocks upwardly. The cutter blocks have protruding splines which are at an angle to the tool axis and fit into matching channels which are part of the cutter body. Consequently when the blocks are pushed upwardly in unison, the splines slide in the matching channels and guide the blocks to expand radially in unison. In this prior document the tool is an under reamer for enlarging a borehole.

Figure 19:
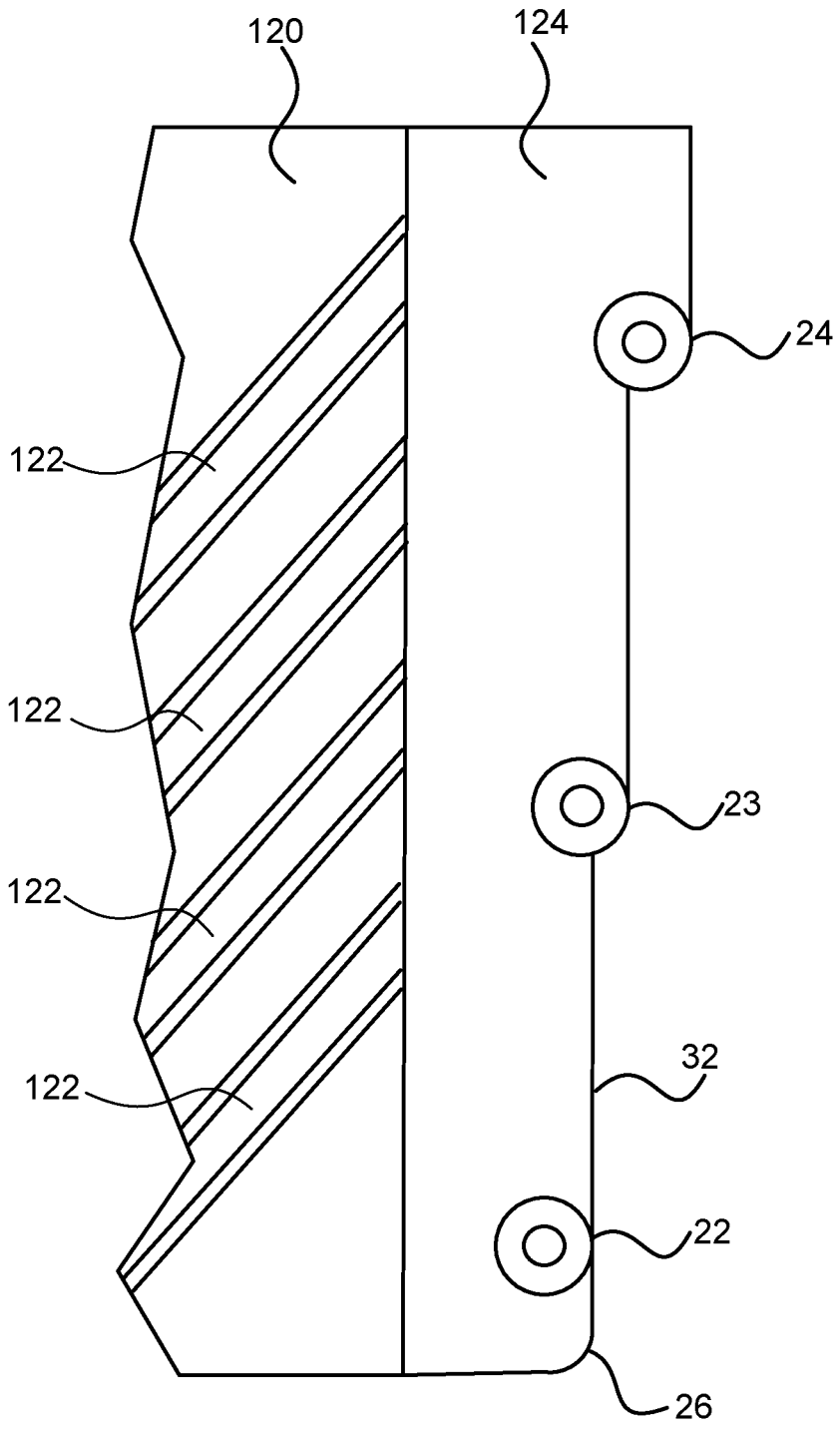
FIG. 19 is a side view of parts of a cutter block used in another rotary tool.

FIG. 19 illustrates use of such a mechanism for a section mill. A cutter block has an inner part 120 with angled splines 122 and an outer part 124. This block is one of three blocks distributed azimuthally around the body of a rotary tool as shown and described in US2003/0155155. The splines 122 correspond to those shown at 650 in FIGS. 7 and 8 of US2003/0155155. The mechanism shown and described in that document is used to push the blocks upwards and outwards while the tool is rotating within tubing which is to be removed. The outer part 124 of each block is the same as a cutting assembly shown in FIG. 2, with hard cutters 22, 23 and 24.

When the blocks are pushed outwardly, their hard cutters cut through the surrounding tubing. When the blocks are fully extended, weight is applied to the tool and this pushes the outer parts 124 of the blocks down onto the tubing which has been cut through. Initial contact is with a lower region 26 of each outer part. This delays contact between the tubing and the hard cutters 22 in a manner which is the same as shown and described with reference to FIGS. 2 and 3.

Figure 20:
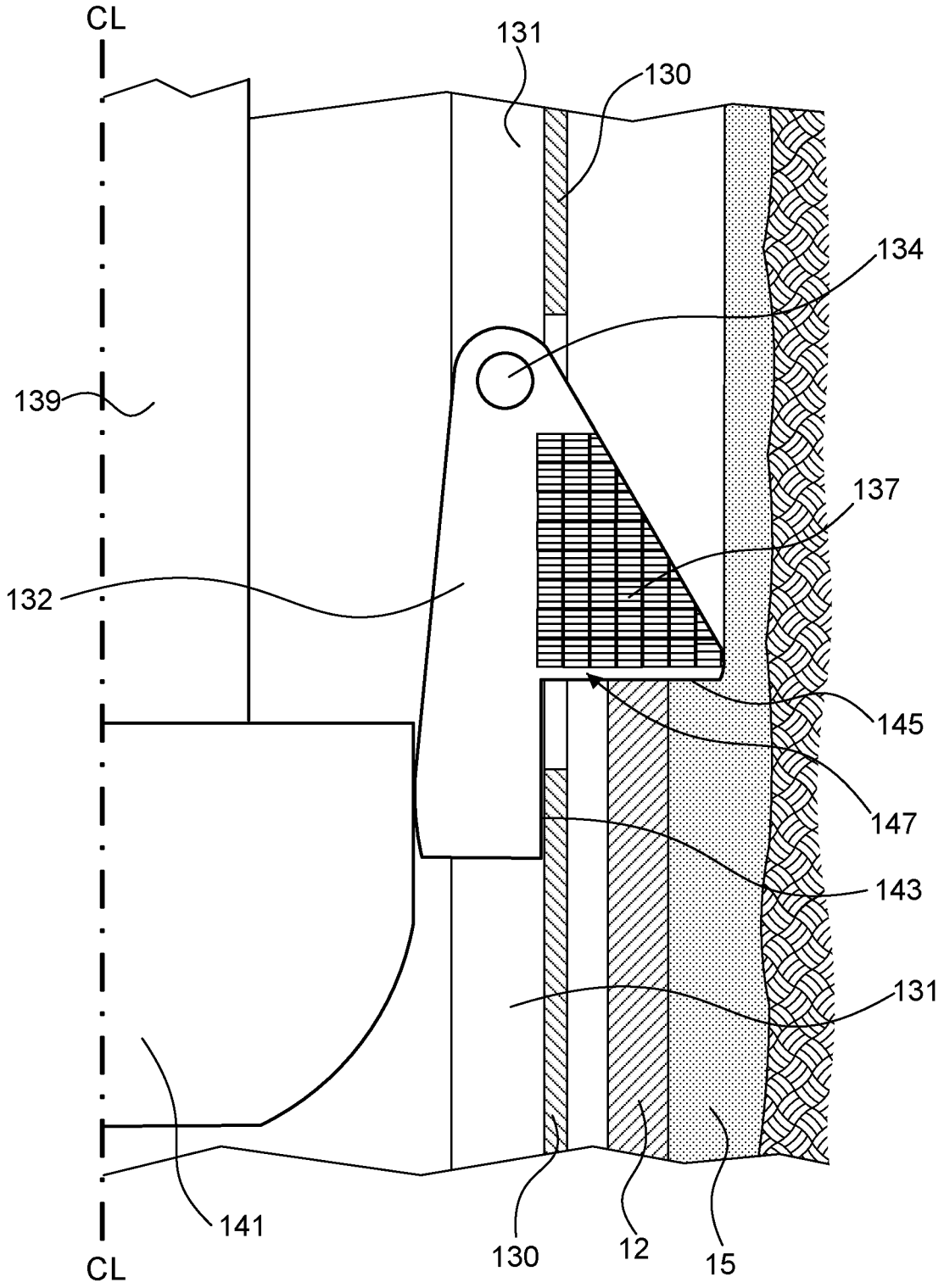
FIG. 20 shows part of a tool which has the structure of a conventional section mill with a cutting blade extended.

FIG. 20 is a sectional elevation showing part of another rotary tool to the right of chain dotted centre line CL-CL. This tool uses a construction which has been widely used in section mills. As shown by FIG. 19, the tool has a cylindrical body with an outer wall 130. Three slots are formed in this body at positions which coincide axially and distributed azimuthally around the tool axis. At either side of each slot there is a plate 131 extending inwardly from the wall 130. A cutting assembly, which comprises an array of square tungsten carbide cutters 137 attached as tiles to an arm 132 made of steel plate, is accommodated within each slot. Each arm 132 is pivoted to swing around a pin 134 supported by the plates 131. Each arm 132 can swing from a retracted position (not shown) to an expanded position shown in FIG. 20. Expansion is brought about by a hydraulic cylinder and piston, not shown, operated by pressure of drilling fluid and connected to drive plunger shaft 139. Pressure of drilling fluid causes the plunger shaft 139 to move downwardly. A domed plunger head 141 on the end of shaft 139 acts on the inside edges of arms 132, forcing each arm to pivot outwardly towards the position shown in FIG. 21. Outward expansion is limited by prolongations 132 of the arms 122 when these prolongations abut the inside face of the tool body's wall 120 as indicated at 143

In a commonly used arrangement, a lower edge of the array of cutters 137 coincides with the lower edge 145 of the arm 132. However, in the tool shown here there is a gap between the lower edge of the array of cutters 137 and the lower edge 145 of the arm 132, exposing a strip 147 of the steel which forms the arm 132.

For use the section mill is included in a drill string and lowered to the point within the borehole tubing 12 where milling is to begin. The drill string is then rotated and the plunger head 131 is driven downwards forcing the arms 122 outwards towards the position shown by FIG. 20. The cutters on the outer edges of the arms 122 cut radially outwards into and through the tubing 12 until the arms are fully extended as shown in FIG. 20. The rotating tool is then advanced axially downwards onto an end face on the tubing 12 where it has been cut through. Initial contact is with the strip 141 of steel. This is worn away by contact with the tubing 12. After the strip of steel has been worn through, the hard cutters along the lower edge of the array of cutters 137 cut downwards into the tubing 12.

It will be appreciated that the embodiments and examples described in detail above can be modified and varied within the scope of the concepts which they exemplify. Proportions may be varied and may not be as shown in the drawings which are schematic and intended to explain layout and action in the embodiments shown. Features referred to above or shown in individual embodiments above may be used together in any combination as well as those which have been shown and described specifically. More particularly, where features were mentioned above in combinations, details of a feature used in one combination may be used in another combination where the same feature is mentioned. Accordingly, all such modifications are intended to be included within the scope of this disclosure as defined in the following claims.

The invention claimed is:

1. A downhole rotary tool for comminuting tubing in a borehole comprising:

a tool body; and a plurality of cutting assemblies projecting from or extensible from the tool body and distributed azimuthally around a longitudinal axis of the tool body, wherein each cutting assembly comprises a supporting structure and a plurality of cutters with cutting surfaces of hard material, the supporting structure including a sacrificial portion axially below a downhole-most cutter of the plurality of cutters, wherein the supporting structure of each cutting assembly has a radially outward facing guide surface at the same radial distance from the tool axis as a radially outer extremity of the downhole-most cutter, positioned to slide over a surface created on the tubing interior by the downhole-most cutter, and wherein the tool is configured such that material on the sacrificial portion of the at least one cutting assembly, which material is softer than the cutting surfaces of the cutters, contacts the tubing before at least one of the hard surfaced cutters when the tool is advanced axially downward onto the tubing.

2. The tool according to claim 1 wherein the cutting surfaces have a Knoop hardness of between 1600 and 1800 and the softer material is metal with a Knoop hardness not exceeding 1200.

3. The tool according to claim 1 wherein the softer material on at least one cutting assembly is positioned to prevent contact between at least one hard faced cutter and the tubing until part of the softer material has been worn away.

4. The tool according to claim 1 wherein the cutters are bodies with hard cutting faces, partially embedded within cavities in the supporting structure with the hard cutting faces exposed as rotationally leading faces of the cutters.

5. The tool according to claim 1 wherein each cutting assembly comprises a plurality of cutters positioned to cut into the tubing, with the cutting positions of these cutters arranged so that distance from a leading end of the rotary tool increases as radial distance from the tool axis increases, whereby removal of tubing progresses outwardly as the tool advances.

6. The tool according to claim 1 configured for the softer material to contact the tubing before at least one hard-surfaced cutter which is shaped and positioned on the cutting assembly such that at least part of its cutting surface is back raked relative to the direction of rotation so that the cutting surface cuts deepest at an edge which is a trailing edge of the cutting surface relative to the direction of rotation and wherein at least part of the back raked cutting surface extends from the said edge with a rake angle between the cutting surface and a perpendicular to a surface of the tubing that is being cut, which rake angle is in a range from 30° to 70°.

7. The tool according to claim 1 wherein the sacrificial portion is radially inward of one or more of the plurality of cutters.

8. The tool according to claim 1 wherein the sacrificial portion is radially inward of each of the plurality of cutters.

9. A method of comminuting tubing in a borehole comprising:

advancing a rotating tool into initial contact with the tubing to commence milling axially along the tubing, wherein the tool comprises a tool body and a plurality of cutting assemblies that are extensible from the tool body and distributed azimuthally around a longitudinal axis of the tool body;

wherein each cutting assembly comprises a supporting structure and a plurality of cutters with cutting surfaces of hard material, and wherein at least one cutting assembly has a sacrificial portion downhole of a downhole-most cutter of the plurality of cutters, the sacrificial portion including a material which is softer than the hard faces of the cutters and positioned to contact the tubing at the initial contact and delay contact between at least one hard surfaced cutter and the tubing; and expanding the cutting assemblies and cutting outwardly through the tubing, before advancing the rotating tool axially into initial contact with the tubing to commence milling.

10. The method according to claim 9 wherein the softer material is harder than the tubing.

11. The method according to claim 9 wherein the rotating tool is brought into the initial contact with the tubing by applying weight to the tool and thereby advancing the tool axially into contact with the tubing.

12. The method according to claim 9 wherein the cutting surfaces have a Knoop hardness of at least 1600 and the material of the sacrificial portion is a metal with a Knoop hardness not exceeding 1200.

13. The method according to claim 9 wherein the softer material is positioned so that after initial contact there is interaction in which:

the softer material cuts some thickness from the tubing, the tubing cuts some thickness from the softer material, or the softer material and the tubing cut some thickness from each other; and the softer material is positioned so that at least one hard surfaced cutter does not contact the tubing until such interaction has taken place.

14. The method according to claim 13 wherein the softer material is harder than the tubing.

15. The method according to claim 9 wherein the softer material on at least one cutting assembly is positioned to prevent contact between at least one hard faced cutter and the tubing until part of the softer material has been worn away.

16. The method according to claim 9 wherein the cutters are bodies with hard cutting faces, partially embedded within cavities in the supporting structure with the hard cutting faces exposed as rotationally leading faces of the cutters.

17. The method according to claim 9 wherein each cutting assembly comprises a plurality of cutters positioned to cut into the tubing, with the cutting positions of these cutters arranged so that distance from a leading end of the rotary tool increases as radial distance from the tool axis increases, whereby removal of tubing progresses outwardly as the tool advances.

18. The method according to claim 17 wherein the supporting structure of each cutting assembly has a radially outward facing guide surface at the same radial distance from the tool axis as a radially outer extremity of the downhole-most cutter, positioned to slide over a surface created on the tubing interior by the downhole-most cutter.

19. The method according to according to claim 9 wherein the softer material delays contact between the tubing and at least one cutter which is shaped and positioned on the cutting assembly such that at least part of its cutting surface is back raked relative to the direction of rotation so that the cutting surface cuts deepest at an edge which is a trailing edge of the cutting surface relative to the direction of rotation and wherein at least part of the back raked cutting surface extends from the said edge with a rake angle between the cutting surface and a perpendicular to the direction of rotation which is in a range from 30° to 70°.

* * * * *